US005408844A

United States Patent [19]

Stokes

[11] Patent Number: 5,408,844

[45] Date of Patent: Apr. 25, 1995

[54] ICE MAKER SUBASSEMBLY FOR A REFRIGERATOR FREEZER

[75] Inventor: Vijay K. Stokes, Niskayuna, N.Y.

[73] Assignee: General Electric Company, Schenectady, N.Y.

[21] Appl. No.: 262,109

[22] Filed: Jun. 17, 1994

[51] Int. Cl.[6] ..... F25C 5/08

[52] U.S. Cl. ..... 62/351; 249/79

[58] Field of Search ..... 62/351; 249/79–81; 219/543

[56] References Cited

U.S. PATENT DOCUMENTS

| | | | |
|---|---|---|---|
| 1,852,064 | 4/1932 | Rosenberg | 62/351 X |
| 2,418,572 | 4/1947 | Brennan | 62/351 X |
| 2,468,492 | 4/1949 | Gazda | 62/351 X |
| 3,952,539 | 4/1976 | Hanson et al. | 62/351 |
| 4,382,177 | 5/1983 | Heaney | 219/543 X |
| 4,547,655 | 10/1985 | Kurata et al. | 219/543 X |
| 4,581,521 | 4/1986 | Grise | 219/543 X |
| 4,725,710 | 2/1988 | Ramus et al. | 219/543 X |

OTHER PUBLICATIONS

SEARS Kenmore Refrigerator Owner's Manual (51771/51778), pp. 10–11.

"Crescent Cube Ice Maker"–a single page describing an ice maker that has been on sale in the United States since 1985.

*Primary Examiner*—William E. Tapolcai

*Attorney, Agent, or Firm*—Douglas E. Erickson; Paul R. Webb, II

[57] ABSTRACT

A subassembly for an ice maker includes a plastic ice cube tray having a housing located within and attached to the refrigerator freezer. The housing has spaced-apart ice cube cavities. An electrically heatable metallic film coating is attached to and generally covers the cavity surfaces. When the cavity surfaces have been heated to detach the formed ice cubes therefrom, in one embodiment, a mechanism is provided to rotate the tray upside down to release the ice cubes. In another embodiment, a fixedly-"upside-down" and semicircular-cylindrical-shaped ice cube tray is placed in a trough, which also has an electrically heatable metallic coating, and a mechanism is provided to rotate the trough to uncover the openings of the ice cube cavities in the tray to release the formed ice cubes when the cavity and trough surfaces have been electrically heated to detach the ice cubes therefrom.

3 Claims, 3 Drawing Sheets

ICE MAKER SUBASSEMBLY FOR A REFRIGERATOR FREEZER

BACKGROUND OF THE INVENTION

The present invention relates generally to an automatic ice maker used in the freezer compartment of a refrigerator, and more particularly to a subassembly of such an ice maker which contains the water during formation of the ice cubes and from which the formed ice cubes are later released.

Conventional refrigerator ice makers form ice cubes in the (zero-degree Fahrenheit) freezer compartment and release the formed ice cubes through a dispenser located in the freezer compartment door. A known refrigerator ice maker fills a metallic (aluminum) ice cube tray with household tap water, allows the water to freeze into crescent-shaped ice cubes, electrically heats a "U"-shaped metallic rod heater located on the bottom of the metallic tray to loosen the individual ice cubes from the tray, uses an electric motor to rotate plastic fingers on a shaft one revolution to sweep the crescent-shaped ice cubes out of the tray into a storage bin, and uses a motor-powered auger in the storage bin to move the ice cubes forward into the dispenser.

Such known refrigerator ice maker has its "U"-shaped metallic rod heater release at least 200 Watts of power during a typical three minute heating cycle. Since a portion of each ice cube may still be attached to the tray after the three minutes, the electric motor is designed to rotate the plastic fingers with sufficient torque to help dislodge any stuck ice cubes from the tray. What is needed is an ice maker with improved ice cube release.

SUMMARY OF THE INVENTION

It is an object of the invention to provide an ice maker subassembly for a refrigerator ice maker wherein such subassembly allows for improved ice cube release.

The ice maker subassembly of the invention is for a refrigerator freezer and includes an ice cube tray having a housing located within, and attached to, the refrigerator freezer. The housing includes spaced-apart ice cube cavities having cavity surfaces. The cavity surfaces have a first electrical conductance. The subassembly also includes an electrically heatable coating attached to, and generally covering, the cavity surfaces. The electrically heatable coating has a second electrical conductance which is greater than the first electrical conductance. Preferably, the housing is a plastic housing, and the electrically heatable coating is a metallic film.

In a first preferred embodiment, the ice cube cavities face generally upward during ice formation, and the subassembly also includes a mechanism (such as one using a solenoid) for rotating the housing in one direction from a first position wherein the ice cube cavities face generally upward to a second position wherein the ice cube cavities face generally downward and for rotating the housing in the opposite direction from the second position to the first position.

In a second preferred embodiment, the housing has a shape of a generally semicircular cylinder with the ice cube cavities facing generally radially outward from the longitudinal axis, and the housing is fixedly oriented with the ice cube cavities facing below the horizontal. A generally semicircular-shaped trough has a concave surface with an electrically heatable coating, and the trough is positioned such that the concave surface covers the openings of the ice cube cavities. A mechanism (such as one using a solenoid) rotates the trough in one direction generally one-half turn from a first position wherein the concave surface covers the openings to a second position wherein the concave surface uncovers the openings, and the mechanism rotates the trough in the opposite direction from the second position to the first position.

Several benefits and advantages are derived from the invention. The electrically heatable coating more evenly heats the interface between the ice cubes and the tray for ice cube detachment which is more complete and which uses less energy. Using a half-turn forward and half-turn back motion for ice cube release (instead of conventionally rotating in one direction only, with stops at each half turn) allows a solenoid to be employed instead of a more costly electric motor. The second preferred embodiment using the semicircular cylindrical tray with ice cube cavities facing radially outward and below the horizontal together with using the semicircular trough to contain the water during ice formation allows for the same quantity of ice to be formed in a narrower tray (i.e., narrower because the tray is wrapped onto a cylindrical surface) which opens up additional freezer space for other uses.

BRIEF DESCRIPTION OF THE DRAWINGS

The accompanying drawings illustrate two preferred embodiments of the present invention wherein.

DETAILED DESCRIPTION OF THE INVENTION

Figure 1:
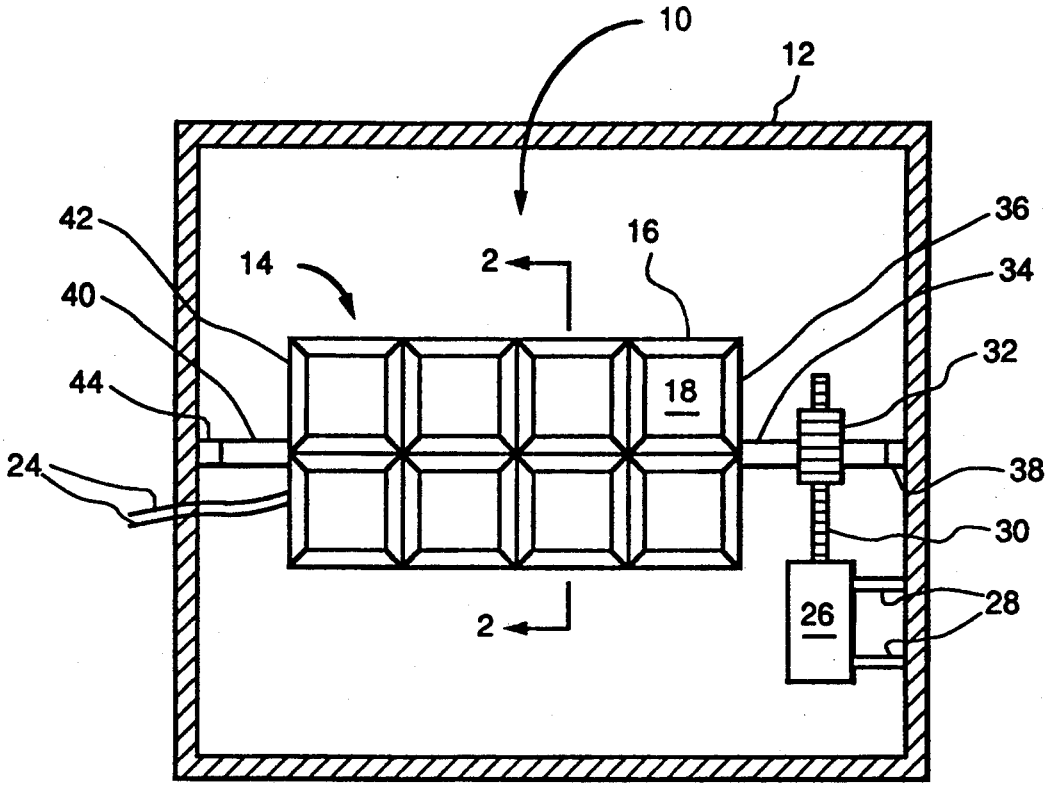
FIG. 1 is a schematic top-planar view of a first embodiment of the ice maker subassembly of the invention installed in a refrigerator freezer shown in section.
Figure 2:
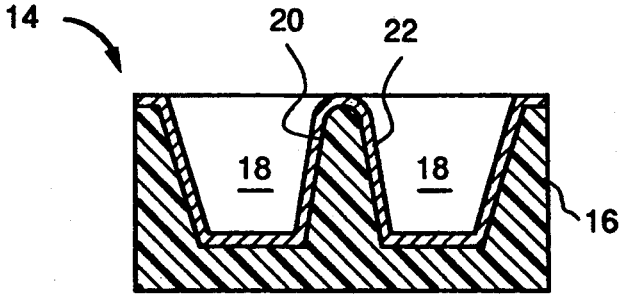
FIG. 2 is a sectional view taken along lines 2—2 of FIG. 1.

Referring now to the drawings, FIGS. 1 and 2 show a first preferred embodiment of the ice maker subassembly 10 of the invention. The ice maker subassembly 10 is for a refrigerator freezer 12 and includes an ice cube tray 14 having a housing 16, wherein the housing 16 is disposed within and attached (directly or indirectly) to the refrigerator freezer 12. The housing 16 includes a plurality of spaced-apart ice cube cavities 18 having cavity surfaces 20, wherein the cavity surfaces 20 have a first electrical conductance. The ice maker subassembly 10 also includes an electrically heatable coating 22 attached to and generally covering the cavity surfaces 20, wherein the electrically heatable coating 22 has a second electrical conductance greater than the first electrical conductance of the cavity surfaces 20.

Preferably, the cavity surfaces 20 have a first coefficient of thermal conductivity, and the electrically heatable coating 22 has a second coefficient of thermal conductivity greater than the first coefficient of thermal conductivity of the cavity surfaces 20. In an exemplary embodiment, the housing 16 comprises a plastic housing 16, such as a generally 1.0-millimeter thick polypropylene housing, and the electrically heatable coating 22 comprises a metallic film 22, such as a thin (e.g., a generally 0.001-millimeter thick) nickel film (which may be capped by a layer of Nichrome) electrolessly metallized or otherwise applied to the plastic housing 16 using conventional techniques such as those used for applying a thin layer of a transparent, electrically heatable metallic coating to an automobile windshield for use in melting ice which may form thereon (such techniques being known to those skilled in the art). The plastic housing 16 may include electrical leads 24 in electrical contact with the electrically heatable coating 22. It is noted that a polypropylene housing 16 has a low thermal conductivity (i.e., it is a good thermal insulator) which causes more heat from the electrically heatable coating 22 to be directed to the ice cubes and not into the housing 16.

In the first preferred embodiment of the invention, the ice cube cavities 18 face generally upward during ice formation, and the housing 16 resembles, in part, a conventional plastic ice cube tray used for manual placement in, and manual withdrawal from, the freezer of a non-ice-maker refrigerator. The ice maker subassembly 10 further includes means for rotating the housing 16 in one direction from a first position wherein the ice cube cavities 18 face generally upward to a second position wherein the ice cube cavities 18 face generally downward and for rotating the housing 16 in a direction opposite to the one direction from the second position to the first position. Preferably, such means includes a solenoid 26 attached to the refrigerator freezer 12 by brackets 28 and having a plunger 30 serving as a rack which engages a pinion 32 to rotate the pinion 32 generally one-half turn in one direction and then to rotate the pinion 32 generally one-half turn in the opposite direction. The pinion 32 is fixedly attached to a first end shaft 34 which has one end fixedly attached to a first end 36 of the housing 16 and which has the other end rotatably attached to the refrigerator freezer 12 by a first bearing 38. A second end shaft 40 is provided having one end fixedly attached to the second end 42 of the housing 16 and having the other end rotatably attached to the refrigerator freezer 12 by a second bearing 44. It is noted that the housing 16 is rotatably attached to the refrigerator freezer 12 by the rotatable end shafts 34 and 40. Other such means for rotating the housing 16 include the means previously described minus the second end shaft 40 and second bearing 44 and/or the means previously described but having the solenoid 26 replaced by other linear motors, and the like, as can be appreciated by those skilled in the art. Even a reversible, rotating motor (not shown) can be used which has its drive shaft attached to (or as one piece with) the first end shaft 34. It is noted that the housing 16 may be attached to the refrigerator freezer 12 by first having the end shafts 34 and 40 (and brackets 28) attached to an ice maker housing (not shown) which is itself attached to the refrigerator freezer 12.

In operation, conventional techniques are used to fill the ice cube cavities 18 with household tap water and to determine when ice cubes have been formed. Then, electricity is applied to the electrically heatable coating 22, of the cavity surfaces 20 of the ice cube cavities 18, through the electrical leads 24 for a predetermined time (or until it has been otherwise determined that the formed ice cubes have become detached from the cavity surfaces 20). Then, the solenoid 26 is activated to move the plunger 30 to rotate the pinion 32 to turn the housing 16 upside down releasing the detached ice cubes into a conventional storage bin below (not shown in the figures). Finally, the solenoid 26 is activated to return the plunger 30, thus turning the housing 16 back to its original position. It is noted that the back and forth turning of the housing 16 will not twist the electrical leads 24 beyond one-half turn.

Figure 3:
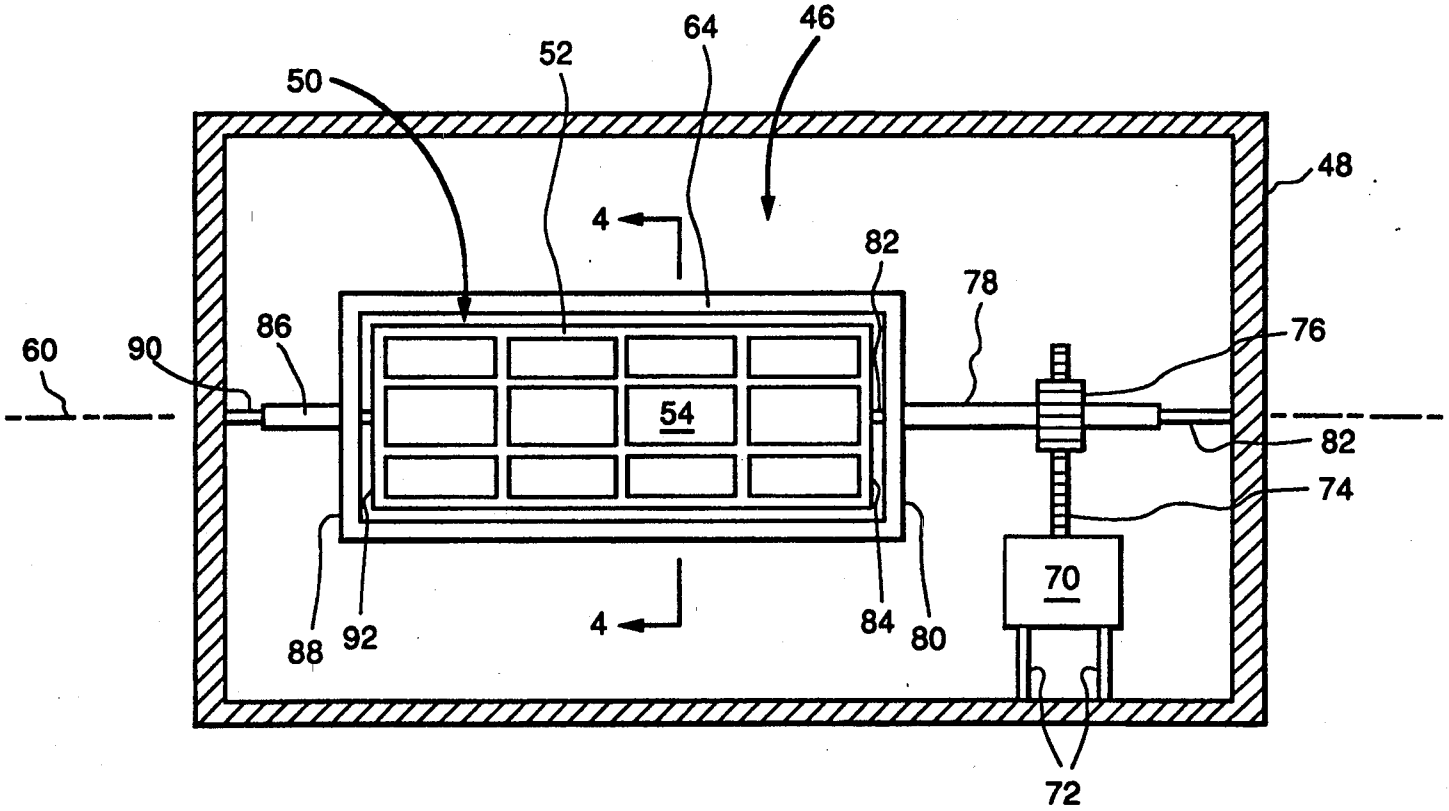
FIG. 3 is a schematic bottom-planar view of a second embodiment of the ice maker subassembly of the invention installed in a refrigerator freezer shown in section, wherein the trough has been rotated to uncover the openings of the ice cube cavities.
Figure 4:
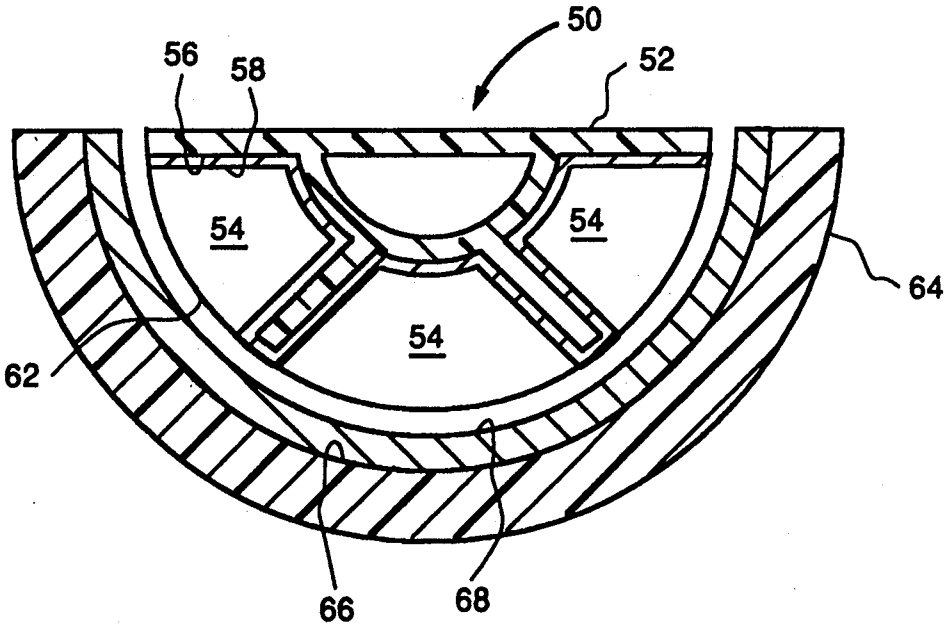
FIG. 4 is a sectional view taken along lines 4—4 of FIG. 3, but with the trough rotated to cover the openings of the ice cube cavities.

Referring again to the drawings, FIGS. 3 and 4 show a second preferred embodiment of the ice maker subassembly 46 of the invention. The ice maker subassembly 46 is for a refrigerator freezer 48 and includes an ice cube tray 50 having a housing 52, wherein the housing 52 is disposed within and attached (directly or indirectly) to the refrigerator freezer 48. The housing 52 includes a plurality of spaced-apart ice cube cavities 54 having cavity surfaces 56, wherein the cavity surfaces 56 have a first electrical conductance. The ice maker subassembly 46 also includes an electrically heatable coating 58 attached to and generally covering the cavity surfaces 56, wherein the electrically heatable coating 58 has a second electrical conductance greater than the first electrical conductance of the cavity surfaces 56. In the second preferred embodiment, the housing 52 has a shape of a generally semicircular cylinder having a longitudinal axis 60, and the ice cube cavities 54 face generally radially outward from the longitudinal axis 60. The housing 52 is fixedly oriented such that the ice cube cavities 54 face below the horizontal. It is noted that each of the ice cube cavities 54 has an opening 62 from which the formed ice cube (not shown) is to be removed.

In the second preferred embodiment, the ice maker subassembly 46 additionally includes a generally semicircular-shaped trough 64 generally coaxially aligned with the longitudinal axis 60. The trough 64 has a concave surface 66 with an electrically heatable coating 68 generally identical to the electrically heatable coating 58 of the cavity surfaces 56 of the ice cube cavities 54. The trough 64 is disposable such that the concave surface 66 covers the openings 62 of the ice cube cavities 54.

In the second preferred embodiment of the invention, the ice cube cavities 54 face generally downward during ice formation and during ice cube removal. The ice maker subassembly 46 further includes means for rotating the trough 64 in one direction generally one-half turn from a first position wherein the concave surface 66 covers the openings 62 of the ice cube cavities 54 to a second position wherein the concave surface 66 uncovers the openings 62 of the ice cube cavities 54 and for rotating the trough 64 in a direction opposite to the one direction from the second position to the first position. Preferably, such means includes a solenoid 70 attached to the refrigerator freezer 48 by brackets 72 and having a plunger 74 serving as a rack which engages a pinion 76 to rotate the pinion 76 generally one-half turn in one direction and then to rotate the pinion 76 generally one-half turn in the opposite direction. The pinion 76 is fixedly attached to a first end shaft 78 which has one end fixedly attached to a first end 80 of the trough 64 and which rotates about a first inner shaft 82 having one end fixedly attached to a first end 84 of the housing 52 and having the other end of the first inner shaft 82 fixedly attached to the refrigerator freezer 48. A second end shaft 86 is provided which has one end fixedly attached to the second end 88 of the trough 64 and which rotates about a second inner shaft 90 having one end fixedly attached to the second end 92 of the housing 52 (such attachment not shown in the figures) and having the other end fixedly attached to the refrigerator freezer 48. It is noted that the housing 52 is fixedly attached to the refrigerator freezer 48 and that the trough 64 is rotatably attached to the refrigerator freezer 48. Other such means for rotating the trough 64 include those for the housing-rotating means of the first preferred embodiment described previously.

In operation, conventional techniques are used to fill the trough 64 (which, as seen in FIG. 4, is covering the openings 62 of the ice cube cavities 54 of the fixedly-"upside-down" housing 52 of the ice cube tray 50) with household tap water and to determine when ice cubes have been formed. Then, electricity is applied through electrical leads (which have been omitted from the figures for clarity) to the electrically heatable coating 58 of the cavity surfaces 56 of the ice cube cavities 54 and to the electrically heatable coating 68 of the concave surface 66 of the trough 64 for a predetermined time (or until it has been otherwise determined that the formed ice cubes have become detached from the cavity surfaces 56 and from the concave surface 66). Then, the solenoid 70 is activated to move the plunger 74 to rotate the pinion 76 to turn the trough 64 one-half turn to uncover the openings 62 (as seen in FIG. 3) releasing the detached ice cubes into a conventional storage bin below (not shown in the figures). Finally, the solenoid 70 is activated to return the plunger 74, thus turning the trough 64 back to its original position. It is noted that the back and forth turning of the trough 64 will not twist the electrical leads (which have been omitted from the figures for clarity) beyond one-half turn.

A conventional heating cycle time to detach ice cubes from the ice cube tray is three minutes. Using a one-dimensional model, a mathematical analysis of the first preferred embodiment of the ice maker subassembly 10 of the present invention showed that the electrically heatable coating 22 would release about 100 Watts of power to detach the ice cubes. This compares with at least 200 Watts of power being released by the "U"-shaped metallic rod heater of a known refrigerator ice maker. The electrically heatable coating 22 would more evenly heat the interface between the cavity surfaces 20 of the ice cube cavities 18 and the ice cubes than does the conventional rod heater design and thus would use less power. In other words, the present invention would use about one-half the power of conventional designs because the electrically heatable coating 22 would produce a uniform distribution of applied heat.

It is noted that for the first embodiment of the ice maker subassembly 10 shown in FIGS. 1 and 2, small notches (not shown in the figures) may be provided in the housing 16 for each ice cube cavity 18 such that water filling one ice cube cavity thereafter will flow more easily to fill all of the other ice cube cavities. For the second embodiment of the ice maker subassembly 46 shown in FIGS. 3 and 4, a small hole (not shown in the figures) may be provided in the housing 52 for each for each ice cube cavity 54 such that air will not be trapped in ice cube cavities during filling of the trough 64 with water (although trapped air may make ice cube detachment easier). For both the first and second preferred embodiments previously described, two or more ice cubes may remain attached together by a thin bridge of ice when they are released from the ice cube tray 14 and 50, such bridge being later broken when the ice cubes fall into the storage bin or when the auger moves the ice cubes towards the dispenser (such storage bin, auger, and dispenser being conventional and not shown in the figures).

The foregoing description of two preferred embodiments of the invention has been presented for purposes of illustration. It is not intended to be exhaustive or to limit the invention to the precise form disclosed, and obviously many modifications and variations are possible in light of the above teaching. For example, the preferred metallic-film, electrically-heatable coatings 22, 58, and 68 may be covered with an additional layer of plastic material if electrical exposure of such coatings is not desired in a particular design. It is intended that the scope of the invention be defined by the claims appended hereto.

I claim:

1. An ice maker subassembly for a refrigerator freezer, said ice maker subassembly comprising:

a) an ice cube tray having a housing, said housing disposed within and attached to said refrigerator freezer, said housing including a plurality of spaced-apart ice cube cavities having cavity surfaces, and said cavity surfaces having a first electrical conductance;

b) an electrically heatable coating attached to and generally covering said cavity surfaces, said electrically heatable coating having a second electrical conductance greater than said first electrical conductance, wherein said housing has a shape of a generally semicircular cylinder having a longitudinal axis, wherein said ice cube cavities face generally radially outward from said longitudinal axis wherein said housing is fixedly oriented such that said ice cube cavities face below the horizontal, and wherein each of said ice cube cavities has an opening; and c) a generally semicircular-shaped trough generally coaxially aligned with said longitudinal axis and having a concave surface with an electrically heatable coating, said trough disposable such that said concave surface covers said openings.

2. The ice maker subassembly of claim 1, also including means for rotating said trough in one direction generally one-half turn from a first position wherein said concave surface covers said openings to a second position wherein said concave surface uncovers said openings and for rotating said trough in a direction opposite to said one direction from said second position to said first position.

3. The ice maker subassembly of claim 2, wherein said means includes a solenoid.

* * * * *